US005277153A

United States Patent [19]

Kakabaker

[11] Patent Number: 5,277,153

[45] Date of Patent: Jan. 11, 1994

[54] SOOT BLOWER SEAL-BEARING ARRANGEMENT

[75] Inventor: Kenneth G. Kakabaker, Kalamazoo, Mich.

[73] Assignee: Durametallic Corporation, Kalamazoo, Mich.

[21] Appl. No.: 7,602

[22] Filed: Jan. 22, 1993

[51] Int. Cl.[5] ..... F22B 37/52

[52] U.S. Cl. ..... 122/390; 15/316.1; 15/317; 122/379; 122/392; 277/81 S; 277/DIG. 8

[58] Field of Search ..... 122/390, 392, 379, 391; 15/316.1, 317, 318; 277/DIG. 8, 84, 81 R, 56, 815

[56] References Cited

U.S. PATENT DOCUMENTS

| | | | |
|---|---|---|---|
| 3,750,230 | 8/1973 | Reed | 122/390 X |
| 4,093,242 | 6/1978 | Terry | 122/392 X |
| 4,750,548 | 6/1988 | Albers et al. | 122/392 X |
| 4,924,817 | 5/1990 | Seelen | 122/390 X |
| 5,090,087 | 2/1992 | Hipple et al. | 15/317 |

OTHER PUBLICATIONS

TRE-SV Bulletin 1139, Copes-Vulcan, Inc., 1990, "soot blowers for the pulp and paper industry", (6 pages).

"Compression Packings" brochure, RM Engineered Products, Inc., Title page, Table of Contents, pp. 20–21 no date.

Sketch, M-3943-D re "Packing Gland", (1 page) no date.

Sketch re "Loaded Gland", (1 page) no date.

*Primary Examiner*—Edward G. Favors

*Attorney, Agent, or Firm*—Flynn, Thiel, Boutell & Tanis

[57] ABSTRACT

A soot blower assembly having a horizontally elongate steam supply tube disposed in cantilevered relationship and having a steam discharge opening at the free end, and a horizontally elongate steam discharge lance telescoped axially over the supply tube. The lance has a rear support hub which exteriorly surrounds the steam supply tube, and a seal-bearing arrangement is mounted within the hub for cooperation with the steam supply tube to permit the lance to move both axially and rotatably relative to the steam supply tube. The seal-bearing arrangement includes an axially elongate bearing sleeve which is mounted on the hub and has an inner bearing surface for rotative bearing engagement with the steam tube. This bearing sleeve is preferably constructed of bronze of similar bearing material, and is axially split to compensate for temperature-induced variations. A lip seal assembly cooperates between the steam supply tube and the hub axially rearwardly of the bearing sleeve for creating a sealed engagement with the periphery of the steam supply tube.

9 Claims, 4 Drawing Sheets

SOOT BLOWER SEAL-BEARING ARRANGEMENT

FIELD OF THE INVENTION

This invention relates to a soot blower assembly such as used in boilers for power plants, and more particularly to an improved seal-bearing construction which permits rotatable and axial movement of a steam discharge lance relative to a steam supply pipe while providing a sealed and supportive relationship therebetween.

BACKGROUND OF THE INVENTION

In fossil-fuel burning power plants and similar boilers, soot deposits collect on the heat transfer pipes, and buildup of such deposits can seriously interfere with proper heat transfer efficiency. Such power plants and boilers are provided with soot blower assemblies for permitting cleaning of soot from the exterior of the heat transfer pipes. Such assemblies typically include an elongate hollow tubular lance which has steam discharge nozzles adjacent the leading end thereof, which lance is moved inwardly into the heat transfer chamber in generally parallel relationship to one or more adjacent heat transfer pipes so as to eject steam against these pipes to dislodge the soot therefrom. The lance in turn is rotatably and axially slidably supported on an elongated and cantilevered stationary steam supply pipe which projects coaxially into the lance, and a packing assembly cooperates between the lance and steam supply pipe to create a sealed relationship therebetween, while at the same time permitting the lance to be axially and rotatably advanced into the heat exchange chamber when removal of soot is desired. Each power plant or boiler typically has a large number of such soot removal devices associated therewith, and the lance of each device must be cantilevered inwardly and moved through a significant extent which may be as much as 40 feet.

At present, conventional soot blowers employs a plurality of packings disposed axially adjacent one another for cooperation between the lance and steam supply pipe. These packings are able to withstand the high temperature of the steam, which is typically supplied at a temperature of about 600° F. However, inasmuch as the soot blowers are activated only periodically, such as once over a several hour interval, the overall soot blower experiences severe differential thermal expansion characteristics when activated due to significant temperature changes when the superheated steam is supplied thereto. This thus makes sealing of the lance to the steam supply tube, while still permitting relative axial and rotary movement therebetween, difficult. While packings have been used with at least limited success, nevertheless packings do possess disadvantages. It has been observed that use of packings in this environment requires constant adjustment in the packing compression in order to achieve a proper seal while still permitting relative movement between the lance and steam supply pipe. If the packing compression is too little, then leakage occurs, and conversely if the compression is too high, then proper movement of the lance is difficult to achieve. The packings have also been observed to cause undesirable wear on the steam supply tube in view of the significant compression required of the packing in order to achieve a desired seal. Even though the use of packings in this environment has possessed recognized disadvantages, nevertheless such packings have been used for many years and continue to be used in this environment in view of the lack of other satisfactory solutions.

Accordingly, it is an object of this invention to provide an improved seal-bearing structure for cooperation in a soot blower assembly, which seal-bearing structure permits elimination of the conventional packings and hence overcomes the disadvantages associated with the prior art structures.

In the present invention, there is provided an improved soot blower assembly wherein an elongated steam discharge lance exteriorly surrounds and is both axially and rotatably movable relative to an elongate cantilevered steam supply tube. The rearward end of the lance includes a tubular housing which supports the lance for axial displacement along a frame, and the rear of the lance is also provided with a seal-bearing arrangement which externally surrounds and cooperates with the cantilevered steam supply tube to concentrically support the steam supply tube within the lance as the latter is displace axially therealong, while at the same time providing a steam-retaining seal therebetween. This seal-bearing arrangement includes a generally elongate bearing sleeve which is disposed annularly between the lance and supply tube. This elongate bearing sleeve, when the soot blower is deactivated so as to be at normal temperature, has an inner annular clearance where it surrounds the supply tube. The elongate sleeve bearing is also provided with a split extending axially and radially therethrough. The sleeve bearing is preferably of bronze or similar bearing material so as to not require lubrication. This bearing sleeve, due to the different thermal expansions and the rapid heat up of the supply tube when steam is supplied thereto, enables the supply tube to expand into engagement with the sleeve bearing, and expansion of the latter is compensated for by the axial slit, whereby the sleeve bearing maintains a rotatable running clearance with the steam supply tube due to permissible circumferential expansion of the split bearing relative to the surrounding lance. The split bearing is disposed on the upstream pressurized steam side of a seal which includes at least one, and preferably two, serially disposed rod-type wiper seals disposed in sealing engagement with the steam supply tube and with a surrounding insert member which is fixed within the lance.

With the improved soot blower assembly of this invention, as briefly described above, the lance can be axially extended and simultaneously slowly rotated about the cantilevered steam supply tube over long axial distances, and as the lance is extended forwardly during the soot blowing operation, the seal-bearing arrangement rotatably and axially bearingly supports and sealingly engages the cantilevered steam supply tube so as to effectively maintain the latter concentric within the lance, particularly when approaching the cantilevered free end of the steam supply tube, so as to overcome tube droop and hence permit successful performance of the soot blowing operation.

Other objects and purposes of the invention will be apparent to persons familiar with structures of this general type upon reading the following specification and inspecting the accompanying drawings.

Figure 1:
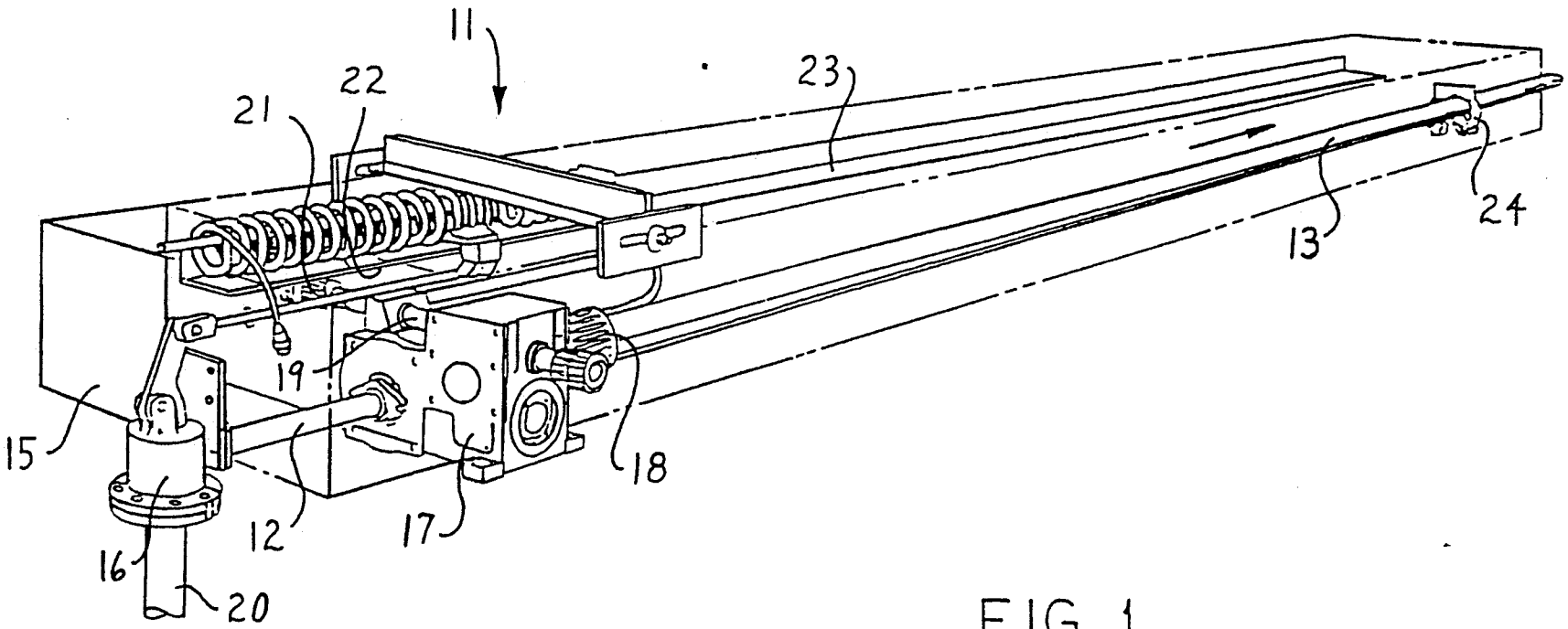
FIG. 1 PRIOR ART
FIG. 1 is a perspective view of a conventional soot blower assembly.

Certain terminology will be used in the following description for convenience in reference only, and will not be limiting. For example, the words "upwardly", "downwardly", "rightwardly" and "leftwardly" will refer to directions in the drawings to which reference is made. The word "forwardly" will refer to advancing movement of the steam discharge lance, which movement is rightwardly in FIGS. 1 and 2. The words "inwardly" and "outwardly" will refer to directions toward and away from, respectively, the geometric center of the assembly and designated parts thereof. Said terminology will include the words specifically mentioned, derivatives thereof, and words of similar import.

DETAILED DESCRIPTION

Referring to FIG. 1, there is illustrated a prior art soot blower assembly 11 which includes an elongate and stationary steam supply pipe 12 telescopically surrounded by an elongate tubular steam discharge lance 13, the latter being generally closed but provided with suitable sideward steam discharge nozzles or orifices 14 (FIG. 2) adjacent the forward or discharge end of the lance. The steam supply pipe 12 projects forwardly in cantilevered relationship throughout a majority of the length of the lance 13 when the lance is in the retracted position illustrated by FIG. 1.

The steam supply pipe 12, adjacent the rearward end thereof, is supported on a stationary frame 15, and is coupled to a suitable valve 16, the latter in turn being coupled to a further steam supply pipe 20 (not shown) which supplies steam from a suitable source. The valve 16 is openable and closeable so as to supply superheated steam, such as steam at a temperature of about 600° F., into the supply pipe 12 only when a soot blowing operation is initiated.

The soot blower assembly includes a traversing housing or carriage 17 which is generally horizontally movable forwardly and rearwardly along the support frame 15, being movably supported thereon by suitable rails and rollers (not shown) in a conventional manner. The carriage 17 mounts thereon a motor 18 which drives, through suitable gearing (not shown) as disposed interiorly of the housing, a cross shaft 19. The shaft 19 has a gear 21 thereon which reacts with an elongate stationary gear rack 22 which extends along an elongate frame member 23 to permit forward advance and retraction of the carriage 17 depending upon the direction of rotation of the motor 18.

The elongate steam discharge lance 13 adjacent the forward end thereof, when the lance is in the retracted position, is movably supported by a suitable support bracket 24 as secured to the frame.

Figure 2:
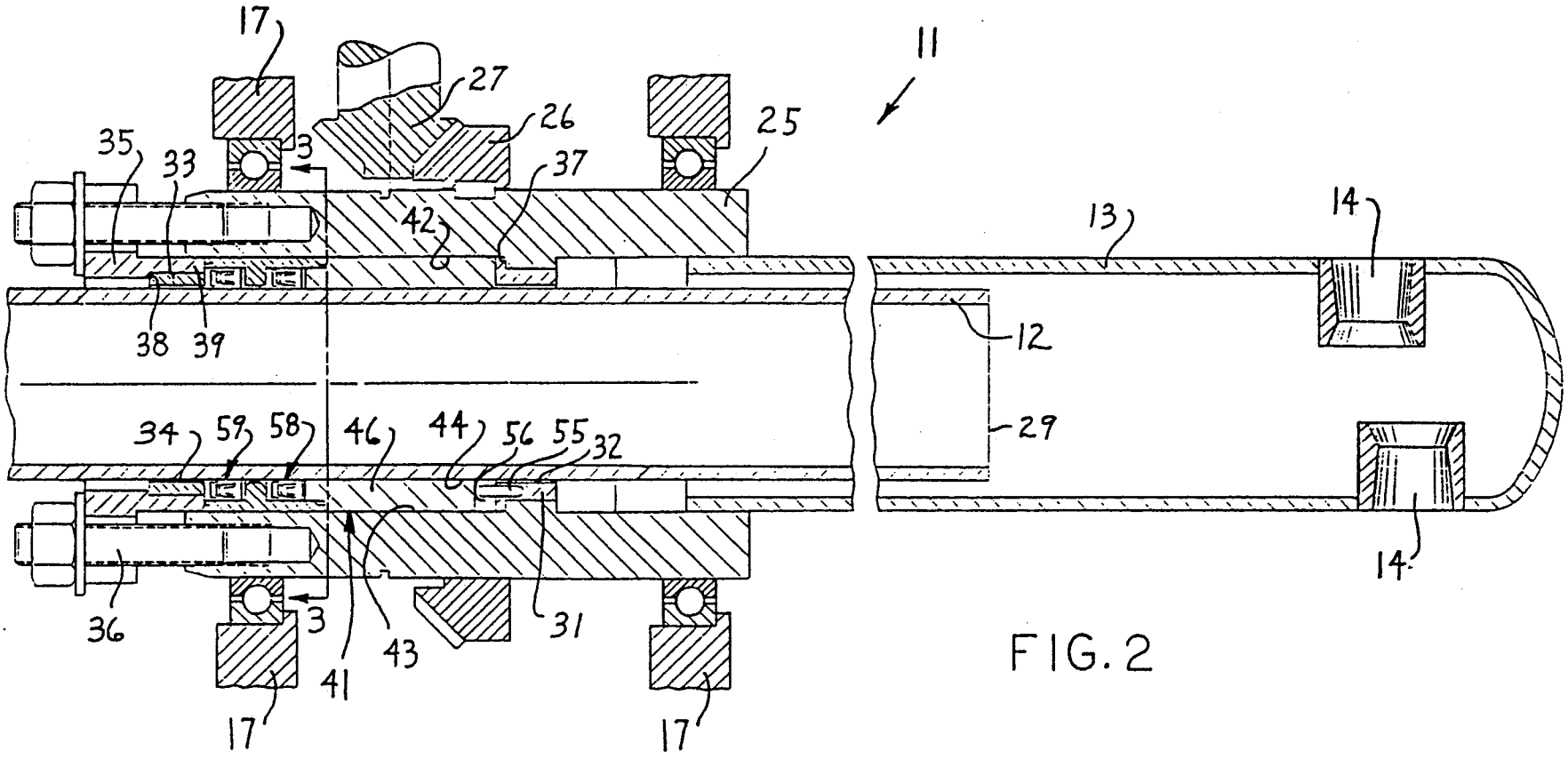
FIG. 2 is an enlarged, fragmentary sectional view showing the improved seal-bearing arrangement of this invention as it cooperates between the steam discharge lance and the steam supply tube.

The rearward end of the lance 13 includes an axially elongate support sleeve or hub 25 (FIG. 2) fixed thereto, the latter projecting horizontally across the carriage 17 and being rotatably supported on the walls thereof by conventional antifriction bearings as illustrated by FIG. 2. This support hub 25 has a driven gear 26 fixed thereto and the latter is in turn engaged with a drive gear 27, which in turn is driven through gearing from the drive motor 18 so as to effect slow rotation of the lance 13 simultaneous with the extension or retraction thereof during activation of the soot blower assembly.

The steam supply or feed tube 12 projects into and through the carriage 17 and is elongated so as to project throughout a significant majority of the length of the lance 13 when the latter is in its retracted position, with the forward or discharge end 29 of the feed tube 12 being open so as to permit unrestricted flow of superheated steam into the lance.

The lance support hub 25 generally concentrically surrounds the feed tube 12 and, adjacent the forward end thereof is provided with a first annular bushing 31 which is fixedly secured within the interior of the lance support hub in surrounding relationship to the feed tube so as to define a small annular clearance 32 therebetween. This bushing sleeve 31 is preferably of a nonlubricated bearing material such as bronze, and abuts against a shoulder 37 formed on the lance hub to facilitate proper positioning within the hub.

A further annular bushing 33 is provided adjacent the rearward end of the lance hub so as to concentrically surround the steam supply tube 12 while being spaced therefrom by a small annular clearance 34. This rearward bushing 33 is also preferably of bronze and is fixedly seated within an annular gland ring 35 which surrounds the feed tube 12. This gland ring 35 is disposed axially adjacent one end of the lance hub 25 and is fixedly but axially adjustably secured thereto by a plurality of fasteners such as screws 36. The gland ring 35 has an annular flange 39 which projects slidably into the bore of the lance hub, and this flange 39 surrounds the bushing 33 with the latter being abutted against a shoulder 38 defined on the flange.

The overall construction of the soot blower assembly, as briefly described above, is conventional. In this conventional construction, however, the annular region within the lance hub 25 as defined between the bushings 31 and 33 is provided with a packing which is axially compressed so as to create sufficient radial expansion to engage the opposed peripheral surfaces defined on the feed tube and lance hub, with the load on the packing being adjusted by suitable tightening or loosening of the fasteners 36.

Figure 3:
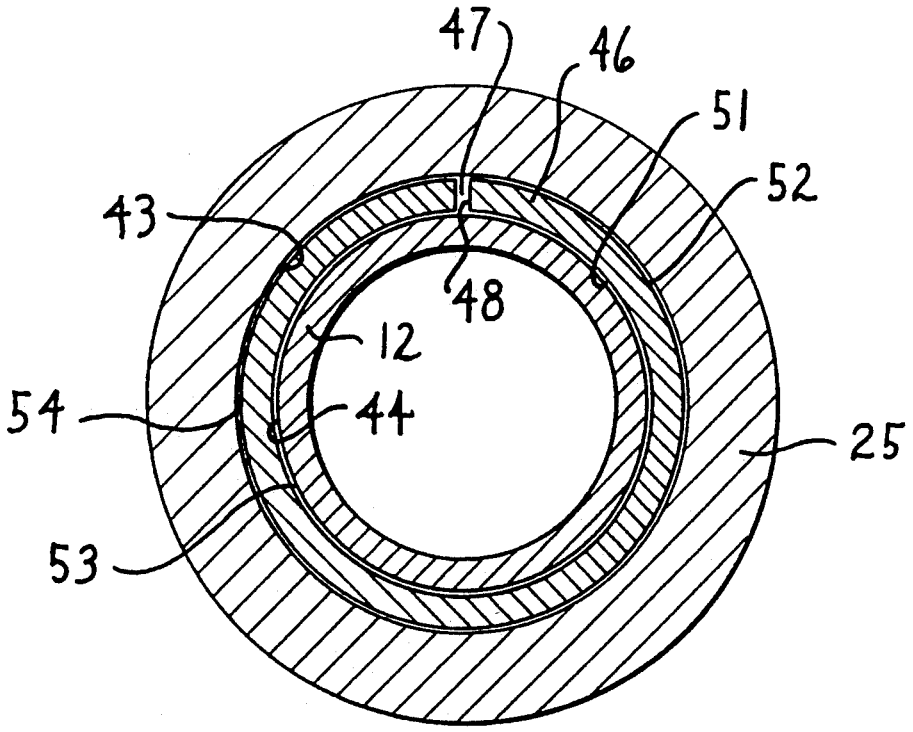
FIG. 3 is a sectional view taken generally along line 3—3 in FIG. 2.
Figure 4:
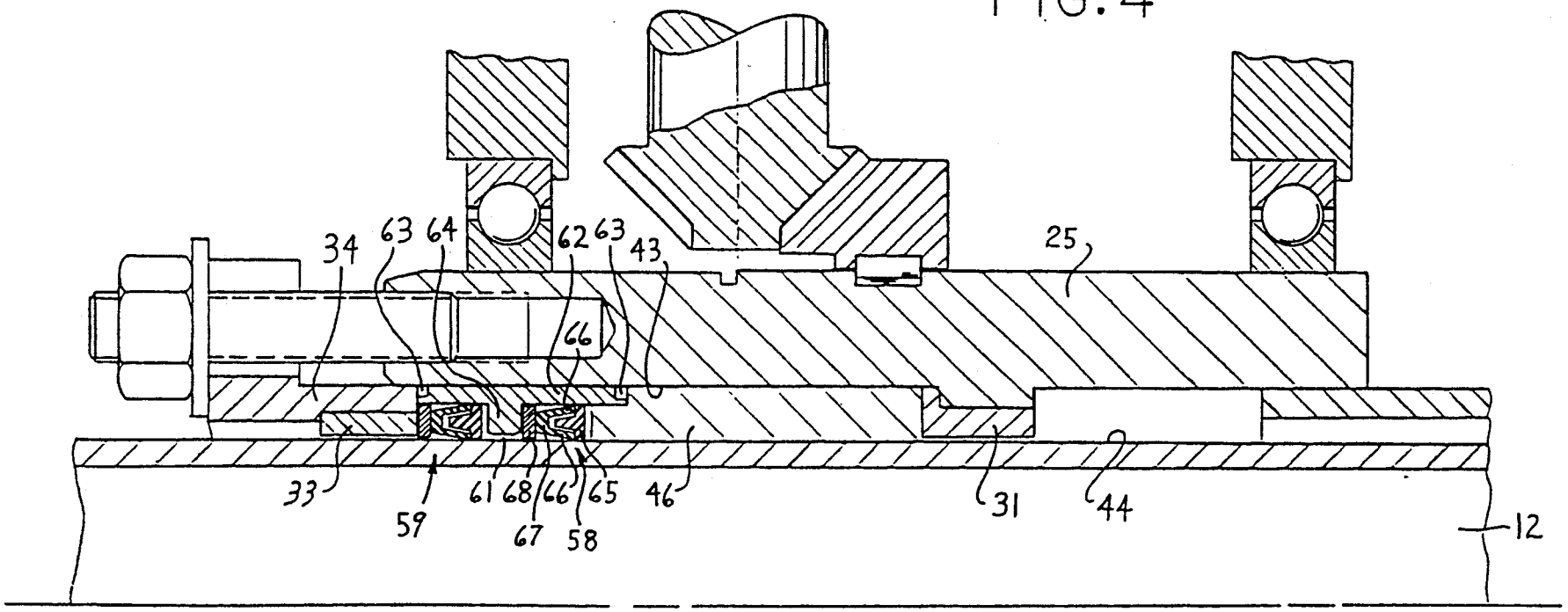
FIG. 4 is an enlargement of part of FIG. 2 for clarity of illustration.

In the present invention, the conventional packing is eliminated and in place thereof the soot blower assembly is provided with an improved seal-bearing assembly 41 as illustrated by FIGS. 2–4.

The seal-bearing arrangement 41 is disposed within an annular chamber 42 as defined between the inner cylindrical wall 43 of the lance hub 25 and the outer cylindrical surface 44 of the feed tube 12. The seal-bearing assembly 41 includes an elongate sleeve-like bearing member 46 which is preferably a one-piece bearing member having a slit or slot 47 extending axially throughout the entire axial length of the bearing member and through the entire radial width thereof so that the opposed edge faces 48 are spaced a small distance apart when the bearing member is in a normal nonstressed condition at conventional ambient temperature.

The sleeve bearing member 46, when in the nonstressed ambient temperature condition, has respective inner and outer diameters 51 and 52, with the inner diameter 51 being slightly greater than the outer feed tube diameter 44 so as to define an inner annular clearance 53 therebetween, and with the outer diameter 52 being typically equal to or preferably slightly smaller than the inner lance tube diameter 43 so as to define an outer annular clearance 54 therebetween.

The bearing member 46 is nonrotatably secured relative to the lance hub 25, and for this purpose a pin 55 is fixedly secured to the front bushing 31 and projects axially rearwardly therefrom for projection into a narrow slot 56 as formed radially through the wall of the sleeve bearing 46 to nonrotatably restrain the sleeve bearing relative to the lance support tube. The forward axial end of the sleeve bearing 46 also axially abuts the front busing 31.

The sleeve bearing 46 preferably is of substantial axial length, such as a length L, to provide for rotative supportive and bearing engagement with the exterior of the feed tube 12 over a significant axial extent. This axial length L of the sleeve bearing 46 is preferably such as to approximately equal or exceed the inner diameter 51 of the sleeve bearing. More specifically, the axial length L is preferably at least about 0.9 times the inner diameter 51 of the sleeve bearing.

Sleeve bearing 46 is also preferably constructed of a bearing material which does not require lubrication, and which preferably has a rather high thermal coefficient of expansion, with the thermal coefficient of expansion of the bearing member 46 preferably being at least of similar magnitude to the thermal coefficient of expansion for the steam feed tube 12, the latter tube typically being of stainless steel. The bearing member 46 is preferably formed of bronze.

The seal-bearing arrangement 41 also includes a pair of rod-type seal assemblies 58 and 59 disposed within the annular chamber 42 axially outwardly of the bearing member 46. The seal assemblies 58 and 59 are preferably substantially identical and are disposed axially in series so as to sealingly engage the outer surface 44 of the steam feed tube 12 and hence prevent escape of steam from the rearward end of the lance support hub 25.

The seal assemblies 58 and 59 are sealingly engaged with and supported by an annular insert ring 62 which externally surrounds the feed tube 12 and is snugly engaged within the bore 43 of the lance support hub 25. This insert ring 62 has the opposite axial end walls thereof engaged with opposed end walls formed on the bearing member 46 and gland member flange 39, with suitable annular sealing or packing rings 63 being disposed between these opposed faces to create sealed relationships therebetween.

The insert ring 62 has a central annular rib or wall 64 which projects radially inwardly toward the feed tube 12 in surrounding relationship thereto, with this central wall 64 being spaced from the outer surface of the feed tube 12 by an annular clearance 61 therebetween. This insert member 62 is also preferably constructed of a bearing material, such as bronze. The lip-type seal assemblies 58 and 59 are supported within the insert ring 62 on axially opposite sides of this central wall 64.

Each lip-type seal assembly 58, 59 includes a wiper or rod-type seal ring 67 which is of a generally U-shaped cross section and includes radially inner and outer annular legs 66 which are adapted to be respectively deflected radially inwardly and outwardly for sealing engagement with suitable surfaces, such as the outer annular surface of the feed tube 12 and the surrounding inner annular surface on the insert ring 62. The sealing rings 67, which can be of conventional elastomeric-like materials selected so as to be able to withstand the high temperatures, are oriented so that the U-shaped cross sections thereof open forwardly in the direction of the steam supply.

Each seal assembly 58, 59 also preferably includes a support ring 65 disposed on the downstream side of the respective seal ring 67, which support ring includes a center portion which projects between the wiper legs 66 to always maintain them in an open position and hence permit entry of steam into the interior of the seal ring to assist in creating proper sealing engagement of the legs against the opposed surfaces. The base of each seal ring 67 is also preferably engaged with a washer-like spacer ring 68, the latter in turn being pushed against a respective force-absorbing axial surface as defined on either the insert wall 64 or the outer bushing 33.

As illustrated by FIG. 2, the seal assemblies 58 and 59 are disposed axially in series and are confined axially between the bearing member 46 and the outer bushing 33 to create a sealed relationship between the feed tube 12 and the lance support hub 25.

In the improved soot blower assembly of this invention incorporating therein the improved seal-bearing arrangement 41, the annular (i.e., diametrical) clearance 53 between the steam supply tube 12 and the bearing member 46 is significantly less than the annular (i.e., diametrical) clearance between the steam supply tube 12 and the bushings 31 and 33. This enables the steam tube 12 to thermally expand into engagement with the inner diameter of the bearing member 46 while still leaving a diametrical clearance between the steam tube and the bushings 31 and 33. The diametrical clearance between the bearing 46 and the hub 25 is very small and is provided to facilitate insertion of the bearing member into the hub.

The soot blower assembly 11 is normally maintained in an inactive retracted position substantially as illustrated by FIG. 1, in which position the tip or free end of the lance 13 is disposed adjacent but withdrawn from the heat exchange chamber of the boiler. When initiation of a soot blowing operation is desired, which initiation may occur about once during a period of about four to eight hours, for example, then the motor 18 is energized whereby gear 21 is rotated and reacts against stationary rack 22 so that the carriage 17 and the lance 13 carried thereby is forwardly advanced (rightwardly in FIGS. 1 and 2) so that the tip of the lance is moved into the boiler with the tip being disposed adjacent and moving generally parallel with heat exchanger tubes located therein. During this forward advance of the lance 13 and its hub 25, the lance and hub are also slowly rotated about the steam tube 12 due to the driving thereof by the gears 26–27.

Upon activation of the soot blower assembly, and typically shortly after the initial forward advancing movement of the lance 13, the steam valve 16 is opened so as to permit supply of high temperature steam into and through the feed tube 12, which steam flows into the interior of the lance 13 and is then discharged through the orifices or nozzles 14 for removing soot from the surfaces of adjacent heat exchanger tubes. The presence of the steam within the lance 13 results in the steam flowing backwardly into the lance support hub 25 and axially past the front bushing 31 and the bearing member 46 so that the steam contacts at least the front seal assembly 58. The steam enters into the interior of the front wiper member 67 and assists in maintaining the legs 66 in snug sealing engagement with the opposed surfaces, with the inner leg 66 also sliding axially and rotatably relative to the outer surface of the steam supply tube 12. Any steam leakage past the first seal assembly 58 is effectively stopped by the second seal assembly 59, and the latter acts as a safety seal in the event of failure or leakage past the first seal assembly 58.

Prior to initiation of the soot blowing cycle, the valve 16 is closed so that steam is not supplied to the tube 12. The soot blower assembly is basically at or close to the surrounding ambient temperature. Upon opening of the valve 16, however, the high temperature steam flows into and through the feed tube 12 and into the lance 13, thereby causing heating and thermal expansion of the various parts of the soot blower assembly, which expansion varies significantly from part to part due to the different times and rates when heating occurs and the different thermal heat transfer coefficients of the different parts. For example, the supply tube 12 is typically of stainless steel and, due to its immediate and intimate contact with the high temperature steam, undergoes an immediate and rather rapid thermal expansion which effectively and normally causes it to expand into engagement with the inner wall of the split bearing member 46 since the latter will be subjected to the temperature at a later time in the overall cycle. Further, any additional tendency for the supply tube 12 to expand is accommodated by the axial split in the bearing member 46 so as to permit the latter to maintain a close but rotatable and sliding running fit between the bearing and the steam tube 12. At the same time, as the bearing member 46 itself heats up and tends to thermally expand, such expansion is permitted again by the axial slit so that thermal expansion of the bearing is permitted by the ability of the bearing ring to grow circumferentially such that the opposed edge faces 48 tend to move toward one another to still maintain a close rotatable and sliding engagement between the bearing member 46 and the feed tube 12. In this manner, a substantially zero running clearance is maintained between the bearing member and the feed tube during the extension and contraction of the lance.

With the improved arrangement of this invention as briefly described above, the seal-bearing arrangement is capable of providing proper sliding and supporting engagement with the steam supply tube 12 so as to maintain it concentrically within the lance throughout the long distance extension and retraction of the lance without effecting binding or undesirable wear, and without requiring frequent periodic adjustment such as with conventional soot blower assemblies employing packings.

With the improved arrangement of the present invention, numerous cycles of activation of the soot blower assembly can be carried out without requiring readjustment after most cycles, such as is typical with prior art systems, and at the same time the operation provides improved sealing and bearing performance without causing wear or degradation of the exterior surface of the steam supply tube at the rate at which said wear occurs with the prior art packing systems.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a soot blower assembly, such as for use on a boiler, said assembly including a horizontally elongate steam supply tube fixed to a frame adjacent one end thereof and projecting in cantilevered relationship therefrom so as to terminate in a free end from which steam is discharged, valve means for controlling supply of high temperature steam to said one end of said supply tube, a horizontally elongate steam discharge tube disposed in surrounding relationship to said supply tube, said discharge tube having a sleeve-like hub part at one end thereof disposed in surrounding relationship to said supply tube, said discharge tube projecting forwardly from said hub and terminating in a free end which is located forwardly from the free end of said supply tube, the discharge tube in the vicinity of the free end thereof being provided with nozzle means for discharging steam, the improvement comprising:

a seal-bearing arrangement coacting between said hub and said supply tube to permit the discharge tube to be axially and rotatably moved relative to the supply tube from a retracted position to an extended position, and vice versa, while steam is supplied to said supply tube, said seal-bearing arrangement including an axially elongate one-piece bearing sleeve nonrotatably secured to said hub in surrounding relationship to said supply tube for rotative and sliding engagement with said supply tube, said bearing sleeve being axially split to compensate for temperature-induced variations when hot steam is introduced into said supply tube, and annular seal ring means mounted on said hub and maintained in surrounding relationship to said supply tube for rotating and sliding sealed engagement therewith at a location disposed axially adjacent but positioned rearwardly of said bearing sleeve.

2. A soot blower assembly according to claim 1, wherein said bearing sleeve has a length which is at least approximately equal to the inside diameter of said bearing sleeve.

3. A soot blower assembly according to claim 1, including front and rear bushings fixed within said hub adjacent opposite axial ends thereof in surrounding relationship to said supply tube, said seal-bearing arrangement being disposed axially between said front and rear bushings, said bearing sleeve and said bushings being diametrically spaced from said supply tube by small annular clearance spaces with the diametrical clearance between said supply tube and said bearing sleeve being less than the diametrical clearances between said supply tube and said front and rear bushings.

4. A soot blower assembly according to claim 3, wherein said bearing sleeve is constructed of bronze.

5. A soot blower assembly according to claim 4, wherein said seal ring means includes an annular lip seal member of channel-like cross section disposed in surrounding relationship to said supply tube, said lip seal member being disposed axially between said bearing sleeve and the rear bushing, said lip seal member having radially inner and outer flexible legs which project axially toward the front bushing, the radially inner leg being maintained in sealing engagement with the supply tube.

6. A soot blower assembly according to claim 5, wherein a pair of said lip seal members are disposed axially in series between said bearing sleeve and said rear bushing.

7. A soot blower assembly according to claim 1, wherein said seal ring means includes an annular lip seal member of channel-like cross section disposed in surrounding relationship to said supply tube, said lip seal member having radially inner and outer flexible legs which project axially toward the bearing sleeve, the radially inner leg being maintained in sealing engagement with the supply tube.

8. A soot blower assembly according to claim 7, wherein a pair of said lip seal members are disposed axially in series.

9. A soot blower assembly according to claim 7, wherein the bearing sleeve is of bronze and has an axially length which at least approximately equals its inside diameter.

* * * * *